US007121803B2

(12) United States Patent
Gautreau et al.

(10) Patent No.: US 7,121,803 B2
(45) **Date of Patent: *Oct. 17, 2006**

(54) COMPRESSOR BLADE WITH DOVETAIL SLOTTED TO REDUCE STRESS ON THE AIRFOIL LEADING EDGE

(75) Inventors: James Charles Gautreau, Greenville, SC (US); Nicholas Francis Martin, Simpsonville, SC (US); Chris A. Rickert, Greenville, SC (US)

(73) Assignee: General Electric Company, Schenectady, NY (US)

( * ) Notice: Subject to any disclaimer, the term of this patent is extended or adjusted under 35 U.S.C. 154(b) by 36 days.

This patent is subject to a terminal disclaimer.

(21) Appl. No.: 11/015,746

(22) Filed: Dec. 20, 2004

(65) Prior Publication Data

US 2005/0232777 A1 Oct. 20, 2005

Related U.S. Application Data

(63) Continuation-in-part of application No. 10/422,701, filed on Apr. 25, 2003, now abandoned, and a continuation-in-part of application No. 10/327,949, filed on Dec. 26, 2002, now Pat. No. 6,902,376.

(51) Int. Cl.
*F01D 5/26* (2006.01)

(52) U.S. Cl. ..... 416/193 A; 416/219 R; 416/248; 416/500; 415/119; 29/889.1; 29/889.2; 29/889.21

(58) Field of Classification Search ..... 416/144, 416/145, 193 A, 219 R, 220 R, 248, 500; 415/119; 29/889.1, 889.2, 889.21

See application file for complete search history.

(56) References Cited

U.S. PATENT DOCUMENTS

| | | | | |
|---|---|---|---|---|
| 2,913,221 | A | 11/1959 | Klint et al. | |
| 2,994,507 | A | 8/1961 | Keller et al. | |
| 4,221,542 | A | 9/1980 | Acres et al. | |
| 4,480,957 | A * | 11/1984 | Patel et al. | 416/220 R |
| 4,682,935 | A | 7/1987 | Martin | |
| 4,872,810 | A | 10/1989 | Brown et al. | |
| 5,123,813 | A | 6/1992 | Przytulski et al. | |
| 5,156,528 | A | 10/1992 | Bobo | |
| 5,205,713 | A * | 4/1993 | Szpunar et al. | 416/193 A |
| 5,244,345 | A | 9/1993 | Curtis | |
| 5,256,035 | A | 10/1993 | Norris et al. | |
| 5,277,548 | A | 1/1994 | Klein et al. | |
| 5,536,143 | A | 7/1996 | Jacala et al. | |
| 5,573,377 | A | 11/1996 | Bond et al. | |
| 5,582,077 | A | 12/1996 | Agram et al. | |
| 5,743,708 | A | 4/1998 | Cunha et al. | |
| 5,924,843 | A | 7/1999 | Staub et al. | |
| 5,947,687 | A | 9/1999 | Mori et al. | |
| 5,988,980 | A | 11/1999 | Busbey et al. | |
| 6,033,185 | A | 3/2000 | Lammas et al. | |

(Continued)

FOREIGN PATENT DOCUMENTS

CH 660207 A5 * 3/1987

(Continued)

*Primary Examiner*—Christopher Verdier
(74) *Attorney, Agent, or Firm*—Nixon & Vanderhye

(57) ABSTRACT

A blade of an turbomachine having an airfoil with a leading edge and a root; a base attached to the root of the airfoil; a dovetail portion of the base engageable with disk; a slot in the base generally parallel to a face of the base extending between opposite sides of the base, and a vibration adsorbing insert snuggly fitted into the slot.

22 Claims, 2 Drawing Sheets

U.S. PATENT DOCUMENTS

| | | | |
|---|---|---|---|
| 6,065,938 | A | 5/2000 | Bartsch |
| 6,095,750 | A | 8/2000 | Ross et al. |
| 6,132,174 | A | 10/2000 | Staub et al. |
| 6,190,131 | B1 | 2/2001 | Deallenbach |
| 6,390,775 | B1 | 5/2002 | Paz |
| 6,402,471 | B1 | 6/2002 | Demers et al. |
| 6,419,753 | B1 | 7/2002 | Wheat et al. |
| 6,457,942 | B1 | 10/2002 | Forrester |
| 6,478,537 | B1 | 11/2002 | Junkin |
| 6,481,967 | B1 | 11/2002 | Tomita et al. |
| 6,520,836 | B1 | 2/2003 | Dean et al. |
| 6,769,877 | B1 * | 8/2004 | Martin et al. ..... 416/193 A |
| 6,902,376 | B1 * | 6/2005 | Gautreau et al. ..... 416/219 R |
| 2002/0081205 | A1 | 6/2002 | Wong |

FOREIGN PATENT DOCUMENTS

| | | | |
|---|---|---|---|
| GB | 906476 | | 9/1962 |
| GB | 1190771 | | 5/1970 |
| JP | 51127302 | A | 11/1976 |
| JP | 57-76208 | A * | 5/1982 |
| JP | 57186004 | A | 11/1982 |

* cited by examiner

COMPRESSOR BLADE WITH DOVETAIL SLOTTED TO REDUCE STRESS ON THE AIRFOIL LEADING EDGE

RELATED APPLICATIONS

This is a continuation in part (CIP) application that claims priority to U.S. patent application Ser. No. 10/422,701, filed Apr. 25, 2003 (now abandoned), and U.S. patent application Ser. No. 10/327,949 (now U.S. Pat. No. 6,902,376), filed Dec. 26, 2002, both of which were pending when this application was filed and are incorporated by reference in their entirety.

BACKGROUND OF THE INVENTION

The invention relates to blades for turbo machines and, in particular, to leading edge treatments to increase blade tolerance to erosion.

Water is sprayed in a compressor to wash the blades and improve performance of the compressor. Water washes are used to clean the compressor flow path especially in large industrial gas turbines, such as those used by utilities to generate electricity. Water is sprayed directly into the inlet to the compressor uniformly across the flow path. The rotating first stage blades of the compressor tend to erode at their leading edges of the airfoil especially at the root of the airfoil, which is where the blade airfoil attaches to the blade platform.

Water spray is a source of erosion to the leading edges of compressor blades and especially to first stage compressor blades. Other sources of erosion include debris and moisture in the intake air that erode the leading edge of a compressor blade and combustion products that erode the trailing edge of a turbine blade (also known as a bucket). Erosion can pit, crevice or otherwise deform the edge surfaces of a compressor blade and turbine bucket. As erosion continues, the population of pits and crevices increases and they deepen into the airfoil surface of the blade.

In addition, a blade is under tremendous stress due to centrifugal forces and forced vibration due to the airflow and the turbo machine. These stresses tear at the erosion pits and crevices and potentially lead to a high cycle fatigue (HCF) crack in the blade. Once a crack develops, the high steady state stresses due to the centrifugal forces that act on a blade and the normal vibratory stresses on the blade can cause the crack to propagate through the blade and eventually cause the blade to fail.

BRIEF DESCRIPTION OF THE INVENTION

The invention may be embodied as a blade of a turbomachine, e.g., an axial compressor comprising: an airfoil having a leading or trailing edge and a root; a platform attached to the root of the airfoil; a dovetail attached to a side of the platform opposite to the airfoil; a neck of the dovetail adjacent the platform, and a slot in the neck and generally parallel to the platform, where said slot extends from a front of the neck to a position in the neck beyond a line formed by an edge of the blade. Further, the slot may extend a width of the neck, and is a key-hole shaped slot.

The slot may have a narrow gap extending from the front of the neck and extending to a cylindrical aperture portion of the slot. The cylindrical aperture has an axis that is offset from said slot narrow gap. In addition, an insert shaped to fit snugly in said slot may be inserted into the slot during installation of the compressor blade. The insert may have a narrow rectangular section attached to a cylindrical section.

The invention may also be embodied as a method for unloading centrifugal stresses from a leading edge of an airfoil of a blade having a platform and a dovetail, the method comprising: generating a slot in the dovetail below a front portion of the platform, wherein the slot underlies an edge of the airfoil; forming a cylindrical aperture at an end of the slot, wherein said cylindrical aperture is generally parallel to the platform and extends through the dovetail, fitting an insert snugly into the slot, and reducing centrifugal and vibratory loads on the edge of the blade by the slot and insert.

In this method, the slot extends the width of the neck and is generated as a key-hole shaped slot. Further, the slot is generated by cutting a narrow gap into a front of the neck and said cylindrical aperture formed at a rear of the narrow gap by drilling through the neck. Alternatively, the slot is generated while casting the dovetail. An insert may be slid into the slot, where the insert substantially fills the slot.

Moreover, the invention may be embodied as a blade of a turbomachine comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion, the undercut defined by a narrow transverse entry slot opening into a rearward transverse groove. When assembled on a compressor wheel, a void created by the undercut is filled by an acoustic damper having substantially the same shape as the void. The acoustic damper may be constructed of a high strength plastic material, such as nylon. The transverse groove may be cylindrical and have a diameter defined by the dovetail size and access requirements, such about 0.5 inch. The undercut may extend in a circumferential direction at least to the leading edge of the airfoil portion.

Even further, the invention may be embodied as a blade of a turbomachine comprising an airfoil portion having an edge, a radially inner attachment portion, and a platform between the airfoil portion and the attachment portion, wherein material is removed from the attachment portion to form an undercut at a front face thereof comprising at least a transverse groove to thereby provide an overhang radially inward of the platform and leading edge of the airfoil portion; wherein, when assembled on a compressor wheel, a void space created by the undercut is substantially filled by an acoustic damper.

DETAILED DESCRIPTION OF THE INVENTION

The geometry of a blade of a turbomachine, e.g., a first stage axial compressor blade, has been modified to reduce the stresses acting on an edge of a blade, e.g., the leading edge of a compressor blade. The tremendous centrifugal and vibratory stresses that act on a blade can cause small pits and surface roughness to initiate a crack leading to blade failure.

Figure 1:
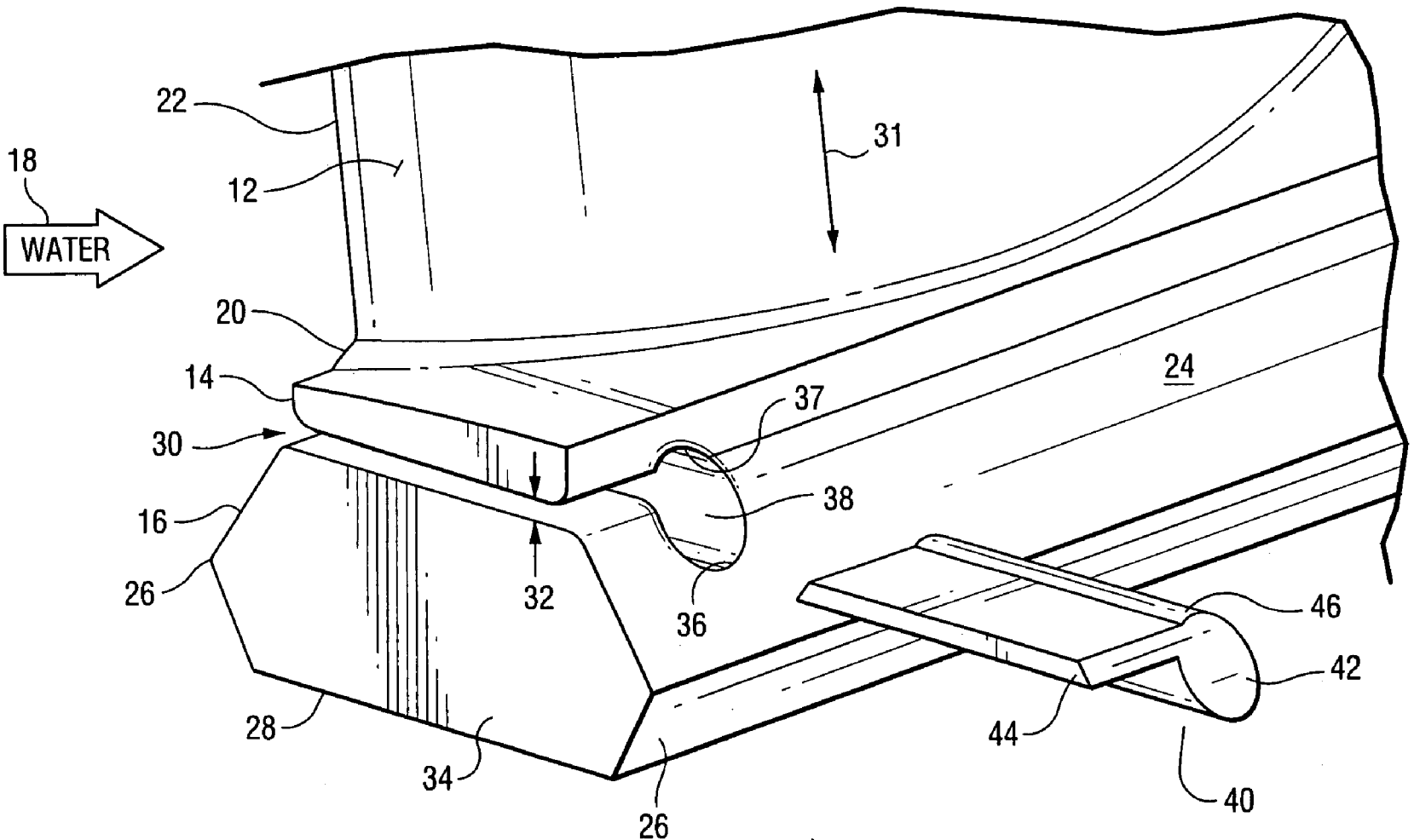
FIG. 1 is an enlarged perspective view of portion of a compressor blade having a slot in its dovetail connector, and an insert for the slot.
Figure 2:
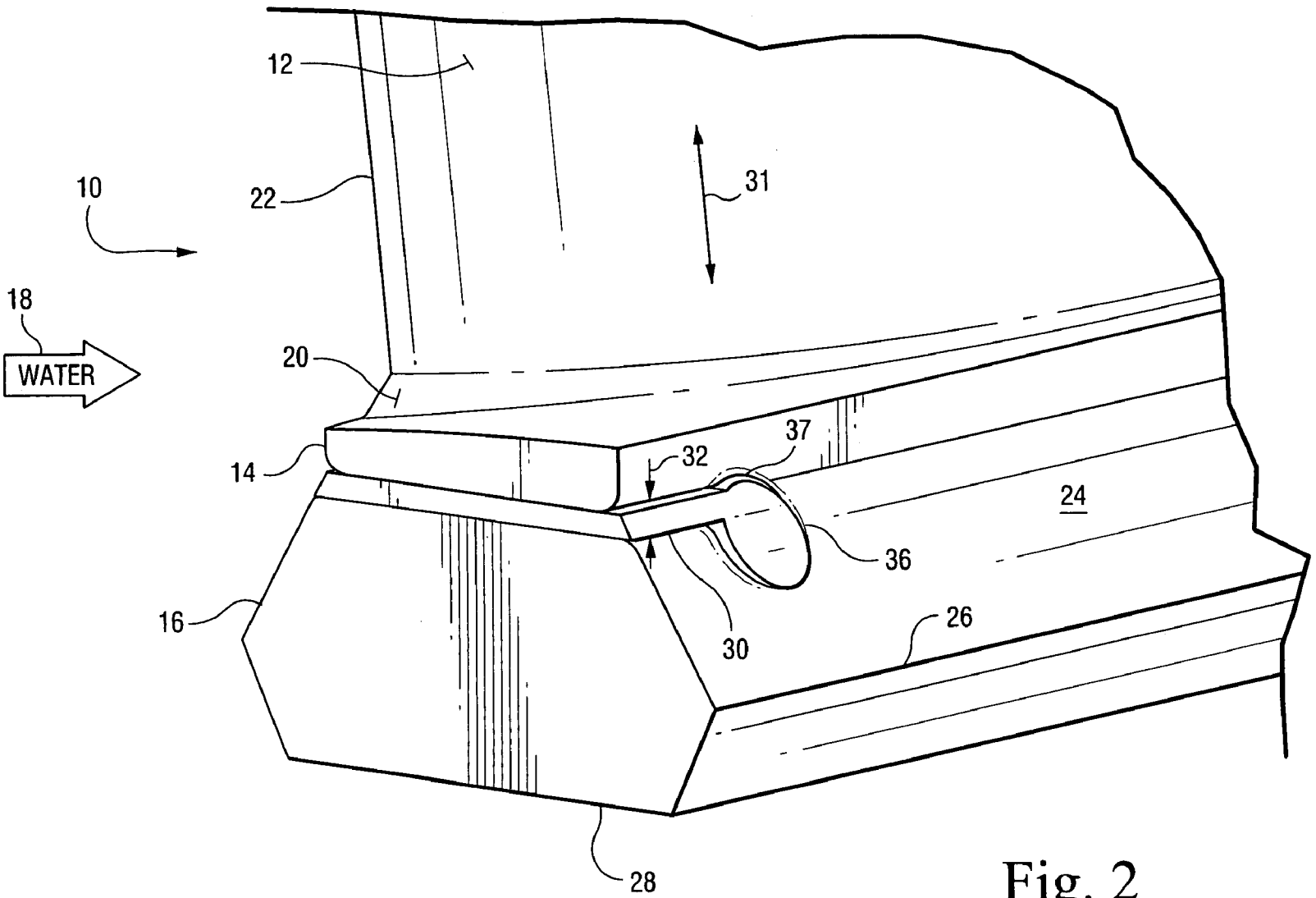
FIG. 2 is an enlarged perspective view of the base of a compressor blade shown in FIG. 1 with the insert in the slot.

FIGS. 1 and 2 show a portion of a first stage blade 10 of a multistage axial compressor of an industrial gas turbine engine, such as used for electrical power generation. The compressor blade includes a blade airfoil 12, a platform 14 at the root 20 of the blade, and a dovetail 16 that is used to connect the blade to a compressor wheel (not shown). The dovetail 16 attaches the blade to the rim of the disk. An array of compressor blades are arranged around the perimeter of the disk to form an annular row of blades. The platform and disk may collectively be referred to as the base of the blade. The base includes a front face, an opposite trailing face, and sides extending between the faces, wherein the sides are opposite each other.

During an on-line water wash, water 18 is uniformly sprayed into the compressor. Large water droplets tend to hit a lower portion of a leading edge of the airfoil surface 12 of the blade that is near the root 20 of the blade.

Air flows over the airfoil surface 12 of the row of compressor blades in each stage of the compressor. The shape and surface roughness of the airfoil surface are important to the aerodynamic performance of the blades and the compressor. Large water droplets hitting the leading edge 22 of the first stage blades can erode, pit and roughen the airfoil surface 12.

The platform 14 of the blade is integrally joined to the root 20 of the airfoil 12. The platform defines the radially inner boundary of the air flow path across the blade surface from which extends the blade airfoil 12. An opposite side of the platform is attached to the dovetail connector 16 for the blade.

The dovetail 16 fits loosely in the compressor disk until the rotor spins and then centrifugal forces push the dovetail firmly radially upward against a slot in the disk. The force of the disk on the dovetail connector counteracts the centrifugal forces acting on the rotating blade. These opposite forces create stresses in the blade airfoil 12. The stresses are concentrated in the blade at certain locations, such as where the root 20 of the blade is attached to the platform 14.

The dovetail 16 has a neck region 24 just below the platform, a wide section 26 with lobes that engage a slot in the disk perimeter, and a bottom 28. A slot 30 extends through the neck below the platform. The slot is perpendicular to the axis 31 of the blade and is generally parallel to the platform. The slot 30 is cut into the dovetail neck 24 below the platform and beneath the leading edge 22 of blade airfoil 12. The slot extends the width of the neck of the dovetail. The slot has a generally key-hole shape with a narrow gap 32 starting at the front of the dovetail and extending underneath the leading edge of the airfoil blade. The end of the slot expands into a generally cylindrical section 36 having a generous radius to reduce stresses caused by the slot on the dovetail. The cylindrical section 36 intersects with the narrow gap 32 of the slot such that the axis 38 of the cylinder is slightly below the centerline of the gap 32. The upper surface of the slot and cylinder (which is the lower surface of the front portion of the platform) is generally flat except for a slight recess 37 corresponding an upper ridge 46 of a cylinder insert 40. The slot may be formed by machining, such as by cutting the narrow gap 32 and by drilling out the cylindrical aperture 36. Alternatively, the slot 30 may be formed with the casting of the dovetail. The transverse cylindrical aperture 36 may be round and have a diameter defined by the dovetail size and access requirements, such as about 0.5 inch. The narrow gap 32 forms an undercut to the platform and may extend in a circumferential direction at least to the leading edge of the airfoil portion.

The slot 30 in the dovetail reduces the stress applied to the leading edge 22 of the airfoil, especially at the root 20 where the airfoil attaches to the platform 14. Stress reduction occurs because the front of the platform is disconnected from the dovetail directly. The front of the platform extends as a cantilever beam over the dovetail. Because the front of the platform is not directly attached to the underlying dovetail, the stress is reduced due to centrifugal forces that would otherwise pass from the dovetail, through the front of the platform and to the leading edge of the airfoil. Due to the reduction of stress on the leading edge 22 of the root 20 of the blade airfoil, the likelihood is reduced that erosion induced pits and other surface defects will propagate into cracks. Accordingly, the slot 30 through the dovetail should significantly reduce the risk of HCF cracks emanating from erosion damage at the lower section of the leading edge of a blade.

An insert 40 is fitted into the slot 30. The insert is show in FIG. 1 as separated from the slot and in FIG. 2 is shown as inserted into the slot. The insert has a shape similar to that of the slot. The insert is a non-metallic component that fits snugly into the slot. The insert may be formed of a plastic material such as nylon. The insert reduces the potential of acoustic resonance in the cavity of the slot. The insert may comprise a cylindrical plug with a rectangular panel extending tangentially from the plug. The insert also prevents dirt, water and other debris from accumulating in the slot. The insert does not transmit centrifugal stresses from the dovetail to the leading edge of the blade via the platform.

When assembled on a compressor wheel (disk), a void created by the undercut is filled by an acoustic damper having substantially the same shape as the void. The acoustic damper may be constructed of a high strength plastic material, such as nylon. The insert has a cylinder portion 42 that fits into the cylinder aperture 36 of the slot. The insert has a rectangular portion 44 that extends from the cylinder and fits in the narrow section 32 of the slot 30. The upper ridge 46 of the cylinder 42 may protrude slightly up from the rectangular portion 44 of the insert.

The slot in the dovetail to unload the compressor blade airfoil is also applicable to unloading a turbine blade. Turbine blades are similar to compressor blades in that both types of blade have an airfoil with leading and trailing edges, concave and an opposite convex airfoil surfaces between the edges; a base (similar in structure to the platform and dovetail of a compressor), wherein the air foil is fixed to an upper surface of the base (e.g., the platform) and a dovetail of the base that fits into an annular turbine disk. A slot in the base of a turbine bucket may undercut the trailing edge of the bucket. A vibratory damper in the slot reduces vibration and stresses on the turbine airfoil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade of a turbomachine comprising:

an airfoil having an edge and a root;

a base comprising a platform attached to the root and the edge of the airfoil and a dovetail;

a slot in a face of the base extending underneath and generally parallel to the platform, and an insert shaped to fit snugly in said slot wherein the insert is a non-metallic damping material, and the insert abuts an upper surface of the slot and abuts a lower surface of the slot.

2. A blade as in claim 1 wherein said slot is a key-hole shaped slot, and the insert comprises a cylindrical plug extending into the base beyond a line formed by the edge of the airfoil.

3. A blade as in claim 1 wherein said slot includes a narrow gap at a front of the slot and a cylindrical aperture at an end of the slot, and the insert comprises a cylindrical plug and a panel extending from the plug.

4. A blade as in claim 1 wherein the slot has a narrow gap extending from the front of the base and the insert comprises a panel shaped to snugly fit in the gap.

5. A blade as in claim 4 wherein said slot further comprises a cylindrical aperture having an axis that is offset from said slot narrow gap and said insert further comprises a cylindrical plug shaped to snugly fit in the cylindrical aperture.

6. A blade as in claim 4 wherein the panel is a narrow rectangular panel.

7. A blade as in claim 1 wherein the insert comprises a plastic material.

8. A blade as in claim 1 wherein the insert comprises nylon.

9. A blade as in claim 1 wherein the turbomachine is an axial compressor and the blade is a compressor blade.

10. A blade as in claim 1 wherein the airfoil root and the edge are attached to a side of the platform, the base is attached to an opposite side of the platform, the dovetail comprises a neck adjacent the platform, and the slot is in the neck.

11. A method for unloading stresses from an edge of an airfoil of a turbomachine blade having a base attached to the edge of the airfoil, the method comprising:

a. generating a slot in the base below the attachment of the base and airfoil, wherein the slot is in a front face of the of the base, the slot extends from one side of the base to an opposite side of the base and the slot underlies the edge of the airfoil;

b. inserting a vibration adsorbing insert into the slot such that the insert fits snugly in the slot, wherein the insert abuts an upper surface of the slot and abuts a lower surface of the slot, and c. reducing centrifugal and vibratory loads on the edge of the blade with the slot and the insert.

12. A method as in claim 11 wherein the blade is a compressor blade.

13. A method as in claim 11 wherein said slot extends a width of the base.

14. A method as in claim 11 wherein said the slot has cylindrical end and the insert comprises a cylindrical plug fitting into the cylindrical end.

15. A method as in claim 14 wherein said slot is generated by cutting a narrow gap in the base and said cylindrical aperture is formed by drilling.

16. A method as in claim 11 wherein the slot is generated in casting the base.

17. A method as in claim 11 wherein the blade is a first stage axial compressor blade and the edge is a leading edge of the compressor blade.

18. A method of unloading a leading edge of an airfoil portion of a compressor blade comprising:

a. providing a blade having an airfoil portion with a leading edge and a base adapted to secure the blade to a compressor wheel;

b. forming a slot in the base, wherein the slot is on the blade radially inward of the leading edge of the base and the slot comprises a narrow transverse entry slot opening into a rearward transverse groove, wherein the slot includes an upper surface and an opposite lower surface, and c. inserting into the slot an acoustic damper having substantially the same shape as the slot, and the damper abuts the upper surface and abuts the opposite lower surface of the slot.

19. The method of claim 18 wherein said acoustic damper comprises a high strength plastic material.

20. The method of claim 18 wherein said acoustic damper comprises nylon.

21. The method of claim 18 wherein the slot extends in a circumferential direction at least to the leading edge of the airfoil portion.

22. The method of claim 18 wherein said groove has a diameter of about ½inch.

* * * * *